United States Patent [19]

Lindahl

[11] 4,324,612

[45] Apr. 13, 1982

[54] PROCESS FOR THE PREPARATION OF GROUNDWOOD PULP

[75] Inventor: Jonas A. I. Lindahl, Domsjo, Sweden

[73] Assignee: Mo och Domsjo Aktiebolag, Ornskoldsvik, Sweden

[21] Appl. No.: 97,466

[22] Filed: Nov. 26, 1979

[30] Foreign Application Priority Data

Nov. 24, 1978 [SE] Sweden ..... 7812111

[51] Int. Cl.[3] ..... D21B 1/14

[52] U.S. Cl. ..... 162/23; 162/24; 162/28; 162/71; 241/21; 241/18; 241/28

[58] Field of Search ..... 162/23, 26, 25, 24, 162/27, 28, 47, 71; 241/18, 21, 23, 28, 15

[56] References Cited

U.S. PATENT DOCUMENTS

| | | | |
|---|---|---|---|
| 3,690,568 | 9/1972 | Alexander | 241/28 |
| 3,693,891 | 9/1972 | Remmer | 241/28 |
| 3,808,090 | 4/1974 | Logan et al. | 162/23 |
| 4,160,693 | 7/1979 | Lindahl et al. | 162/71 |
| 4,207,139 | 6/1980 | Haikkala et al. | 162/23 |
| 4,207,140 | 6/1980 | Lindahl | 162/23 |

*Primary Examiner*—William F. Smith

[57] ABSTRACT

A process is provided for preparing groundwood pulp from debarked pulpwood logs, which comprises grinding the logs in the presence of water under a superatmospheric pressure of a gas selected from the group consisting of steam, air, and steam and air, and forming and discharging a pulp suspension in the resulting aqueous liquor, while continuously supplying water during the grinding in a volume of less than 35 parts per part of bone dry pulp at a rate of addition such that the temperature of the discharged pulp suspension is below 200° C. and preferably below 180° C. and within the range from about 1.5 to about 50, preferably from 2 to 8, times the temperature in °C. of the added water at a pressure within the range from about 8 to about 40 kiloponds/cm$^2$, preferably from 10 to 30 kiloponds/cm$^2$, higher than the superatmospheric pressure and at a temperature within the range from about 2 to about 63° C.; then, optionally, any one or more of the steps of centrifugally separating steam from the pulp suspension and using the separated hot steam for heating purposes; thickening the pulp suspension within the range from about 5 to about 50% and supplying water separated therefrom to the grinding; and adding bleaching chemicals to the pulp and bleaching the pulp; the groundwood pulp is obtained in a higher pulp concentration and at considerable saving in energy, can be used with our without bleaching, and has a high content of long flexible fibers.

11 Claims, 4 Drawing Figures

PROCESS FOR THE PREPARATION OF GROUNDWOOD PULP

Common groundwood pulp is produced at atmospheric pressure by pressing debarked pulpwood logs against a rotating cylindrical stone. Exemplary of such processes are Offenlegungsschrift No. 2,336,350 and Norwegian Pat. No. 33,951. The intense heat generated during the grinding results in a vigorous heating up of the grindstone and the wood material. The area of contact between wood and stone is called the grinding zone. To control the heating in the grinding zone, large volumes of water are added. Besides the cooling or temperature-regulating effect in the grinding zone, the water has another important function, and that is, to wash the grindstone surface clean of loose pulp fibers. For this reason, the water is usually applied as a spray or shower to the grindstone, and is referred to as shower water.

While the water is intended for cooling, it has been considered that a grinding at high temperatures is beneficial, and therefore the shower water is warm, and as a rule has a temperature of at least 65° C. This is because it has been found that to carry out the grinding of debarked pulpwood logs in the production of groundwood pulp at elevated temperatures reduces the energy requirement for the grinding, and facilitates defibration. It has also been suggested that it is especially advantageous to carry out the grinding under superatmospheric pressure in the presence of steam or air at an elevated temperature, since this further reduces energy consumption, and increases the tear resistance of the resulting pulp, as well as the freeness and bulk of the pulp produced.

Thus, Swedish Pat. No. 318,178 describes a method for the defibration of pulpwood logs by subjecting the material to grinding under a superatmospheric pressure of inert gas within the range from about 1.05 to about 10.5 kp/cm$^2$ above normal atmospheric pressure and preferably within the range from about 2.1 to about 7 kp/cm$^2$ above normal atmospheric pressure, while supplying water at at least 71° C. and preferably about 99° C. during the grinding. This process is said to provide a groundwood pulp having a better drainability and improved tear resistance, while the energy consumption is less than that normally required in the preparation of groundwood pulp.

U.S. Pat. No. 3,808,090, patented Apr. 30, 1974, to Logan and Luhde, in the text up to column 9, line 46, FIGS. 1 to 8 and Tables I to III is almost identical to the text of Swedish Pat. No. 318,178. The remainder of the Logan et al U.S. Patent, from column 9, line 47 to column 13, line 42, is disclosed in Swedish Pat. No. 336,952, a patent of addition to No. 318,178, claiming the benefit of the priority of U.S. Ser. No. 569,351 of Aug. 1, 1966, now abandoned, referred to by Logan et al as a predecessor application to the application on which U.S. Pat. No. b 3,808,090 issued. Swedish Pat. No. 336,952 includes Tables IV and V and FIG. 9 of the Logan et al U.S. Pat. No. 3,808,090.

The Logan et al U.S. Patent during the mechanical abrasion of the wood applies a pressure within the range from about 0.7 to about 4.2 kp/cm$^2$, i.e., from 10 to 60 psig, with about 2.1 kp/cm$^2$ (30 psig) as a preferred range, a considerably narrower pressure range than that disclosed in Swedish Pat. No. 318,178.

Swedish Pat. No. 336,952 in this step applies a pressure within the range from about 1.4 to about 2.8 kp/cm$^2$, i.e., from 20 to 40 psig, which corresponds to the pressure disclosed in U.S. Pat. No. 3,948,449, patented Apr. 6, 1976. U.S. Pat. No. 3,948,449 in this step applies a pressure of from 10 to 80 psig (0.7 to 5.6 kp/cm$^2$), preferably from 20 to 40 psig (1.4 to 2.8 kg/cm$^2$).

However, it has been found that this process has numerous disadvantages. The brightness is unsatisfactorily low, by present-day standards, only about 48 to 54% GE being obtained, according to Table I, page 4, of the patent. If bleaching chemicals are added to the shower water, the brightness is not noticeably improved, being within the range from about 38 to about 55% GE, even though very large amounts of bleaching chemicals are added. Tensile strength, although better than for ordinary groundwood pulp, as well as tear index and smoothness, are not as high as would be desirable.

U.S. Pat. No. 4,029,543 to Lindahl, patented June 14, 1977, provides a process for the preparation of peroxide-bleached, mechanical cellulose pulps of improved brightness and strength. A mechanical freeing of the fibers is provided for instance by bringing the wood in the form of logs into contact with the surface of a rotating grindstone (groundwood) or grinding the wood in the form of chips in a disc refiner (refiner pulp). One further type of mechanical freeing can also be made in a so-called FROTAPULPER ®, which is an apparatus principally consisting of two screws, which knead the wood material which is present in the form of large splinters, knots etc. In mechanical freeing of the fibers the pulp will contain all components of the original wood with the exception of the water-soluble material.

The process is characterized by the fact that the mechanical freeing of the fibers is carried out in the presence of only spent liquor from the peroxide bleaching step, said liquor having a pH higher than 7.

The effect obtained is high brightness, improved strength and decreased consumption of chemicals.

In accordance with the invention of Ser. No. 954,715, now U.S. Pat. No. 4,207,140, energy requirements are further reduced and the quality of the groundwood pulp improved by grinding debarked pulpwood logs under a superatmospheric pressure of a gas selected from the group consisting of steam, air, and steam and air, while continuously supplying thereto water comprising spent bleaching liquor at a temperature of at least 70° C. and forming a pulp suspension in the resulting aqueous liquor; centrifugally separating steam from the pulp suspension and using the separated hot steam to heat the spent bleaching liquor supplied to the grinding; thickening the pulp suspension to a concentration within the range from about 5 to about 40% and supplying water separated therefrom to the grinding; diluting the pulp suspension to a concentration within the range from about 0.5 to about 4.0%; screening the pulp suspension; thickening the pulp suspension to a concentration within the range from about 10 to about 50% and supplying water separated therefrom to the screening; adding bleaching chemicals thereto and bleaching the pulp, diluting the bleached pulp with spent bleaching liquor to a concentration within the range from about 1 to about 6%; thickening the bleached pulp suspension to a concentration within the range from about 10 to about 50%; separating, heating and recycling to the grinding spent bleaching liquor containing residual bleaching chemicals.

The resulting groundwood pulp not only is obtained at a considerably lower energy consumption, but has substantially improved strength as well as greatly improved brightness, extending to as high as 80% SCAN. The groundwood pulp also has a very high content of flexible fibers, making possible the manufacture of paper with a lower grammage and a lower roughness than has heretofore been possible with groundwood pulps.

In accordance with the invention of Ser. No. 954,714, now U.S. Pat. No. 4,207,139, energy requirements in the production of groundwood pulp are further reduced and the quality of the pulp improved, including in particular, brightness and strength, by grinding debarked pulpwood logs under a superatmospheric pressure of a gas selected from the group consisting of steam, air and steam and air, while continuously supplying thereto process white water and water separated in thickening groundwood pulp suspension at a temperature within the range from about 75° to about 100° C., and forming a pulp suspension in the resulting aqueous liquor; centrifugally separating steam from the pulp suspension, and using the separated steam to heat the water supplied to the grinding; thickening the pulp suspension to a pulp concentration within the range from about 5 to about 40% and supplying water separated therefrom to the grinding; diluting the thickened pulp, and screening the diluted pulp suspension; thickening the screened rejects suspension to a pulp concentration of at least 10%, and defibrating the screened rejects suspension in a refiner; recycling the screened rejects suspension to the from-steam-separated pulp suspension; and mixing the thickened and refined rejects suspension, having a pulp concentration of at least 8%, with the pulp suspension, thereby increasing the pulp concentration of the from-steam-separated-pulp suspension, and thus facilitating its thickening.

The process of the invention makes it possible to produce groundwood pulp while consuming much less energy than in the normal procedures for grinding lignocellulosic material. The groundwood pulp obtained in accordance with the process of the invention has a greater brightness and an improved strength (as compared with the known groundwood pulps), which make it particularly suitable for the use in the manufacture of paper. Paper having a greater quality range can be obtained from the groundwood pulps in accordance with the invention.

The processes according to the prior art have several drawbacks. One disadvantage with grinding at atmospheric pressure and with grinding at superatmospheric pressure is that large volumes of shower water are required. Thus, the shower water mixed into the pulp amounts to from 40 to 200 parts per part of pulp. This means that a very dilute pulp suspension is discharged from the grinding, containing only from 0.5 to 2.5% by weight of pulp.

Consequently, the volume of discharged pulp suspension is very large. If for instance one has several grinders, the pulp collection tank must be very large. Furthermore, unnecessarily great quantities of energy are consumed for the transport of the dilute pulp suspension, since this mainly consists of water. A low pulp concentration is also a disadvantage if the pulp later on has to be thickened and/or bleached. In the thickening operation, costly large volume drum filters as a rule must be used, and if the pulp is to be bleached a dewatering operation must be carried out in some sort of press.

According to Swedish Pat. No. 318,178, and U.S. Pat. No. 3,808,090, the shower water should be as hot as possible. Therefore large amounts of energy are consumed in order to satisfy the need of hot shower water.

In fact, the prior art technique of using hot shower water as in Swedish Pat. No. 318,178, U.S. Pat. No. 4,808,090, Offenlegungsschrift No. 2,336,350 and Norwegian Pat. No. 33,951 requires that the temperature of the shower water be very close to the temperature of the pulp suspension being discharged from the grinder. The temperature of the pulp suspension in the inner part of the grinder is also very close to the temperature of the shower water added and the temperature of the discharged pulp suspension.

In accordance with the present invention, a process is provided for the preparation of groundwood pulp from debarked pulpwood logs, which comprises grinding the logs in the presence of water under a superatmospheric pressure of a gas selected from the group consisting of steam, air, and steam and air, and forming and discharging a pulp suspension in the resulting aqueous liquor, while continuously supplying water during the grinding in a volume of less than 35 parts per part of bone dry pulp at a rate of addition such that the temperature of the discharged pulp suspension is below 200° C. and preferably below 180° C. and within the range from about 1.5 to about 50, preferably from 2 to 8, times the temperature in °C. of the added water at a pressure within the range from about 8 to about 40 kiloponds/cm$^2$, preferably from 10 to 30 kiloponds/cm$^2$, higher than the superatmospheric pressure and at a temperature within the range from about 2° to about 63° C.; then, optionally, any one or more of the steps of centrifugally separating steam from the pulp suspension and using the separated hot steam for heating purposes; thickening the pulp suspension within the range from about 5 to about 50% and supplying water separated therefrom to the grinding; and adding bleaching chemicals to the pulp and bleaching the pulp; the groundwood pulp is obtained in a higher pulp concentration and at considerable saving in energy, can be used with our without bleaching, and has a high content of long flexible fibers.

Thus, in the process of the invention if the temperature of the water added is about 52° C., the temperature of the pulp suspension from discharge part of the grinder is about 98° C., which represents a large difference between the ingoing and outgoing temperatures in contrast to the prior art, where these temperatures are about the same. This is a large difference, particularly since in the invention a substantially lower volume of shower water is used. Hence, in order to be able to cool the surface of the grindstone satisfactorily, the temperature of the shower water has to be considerably lower than the temperature of the outgoing pulp suspension. Moreover, in order to keep the surface of the grindstone clean from fibers with a lower volume of shower water, the water is added at a higher injection pressure. The result is a pulp concentration in the pulp suspension discharged from the grinder that exceeds 2.9%, which is higher than normal.

Not only is it possible to produce a groundwood pulp suspension having a considerably reduced water content, but at the same time the energy consumption during the process is considerably lower. This result contradicts prior practice, in which large amounts of hot shower water are always added to the grinder.

The smaller amount of shower water that is added according to the present invention means that the shower water does not need to be heated before being added, which reduces energy consumption.

The higher pulp concentration in the discharged pulp suspension, within the range from about 3 to about 40%, preferably from 3.5 to 10%, makes it possible to process the groundwood pulp suspension in a hydrocyclone for separation of steam, and then, without an intermediate dewatering stage, further treat the pulp in the desired way, for instance direct dewatering to a high pulp consistency (20 to 50%) before a bleaching stage. The intermediate dewatering stages previously necessary are avoided, which means that expensive and space-requiring drum filters are not needed.

In spite of the smaller amount of shower water, a larger amount of surplus steam is obtained from the hydrocyclone than in the known processes. This surplus steam can be used for heating purposes, for instance, the drying of pulp, or the generation of electric energy in a subatmospheric pressure turbine. Furthermore, the higher pulp concentration makes it possible to reduce the size of the collection tank required when many grinders are used, and the energy consumption for the transport of the pulp suspension is reduced.

A further important advantage when using a subsequent peroxide bleaching stage is that the decomposition of peroxide in the recirculation of spent bleaching liquor is very low, or even zero, because of the low temperature of the shower water.

The groundwood pulps obtained in the process of the invention has a high content of long and flexible fibers, which makes it possible to produce a strong paper. Alternatively, this property may be used to produce paper having good mechanical properties with lower substance (surface weight) than normal.

The groundwood pulps obtained in accordance with the invention can be mixed with chemical pulps, for example, sulphate or sulphite pulp, in a larger proportion than has heretofore been possible, thus reducing the manufacturing cost of paper manufactured therefrom. This groundwood pulp is also suitable for use in the manufacture of paper over a larger and more varied quality range than is usual in the case of groundwood pulps within the yield range of from 90 to 99%, due to a larger percentage of long fibers and higher strength.

Preferred embodiments of the process of the invention are illustrated in the flow sheets of FIGS. 1 and 2.

Figure 1:
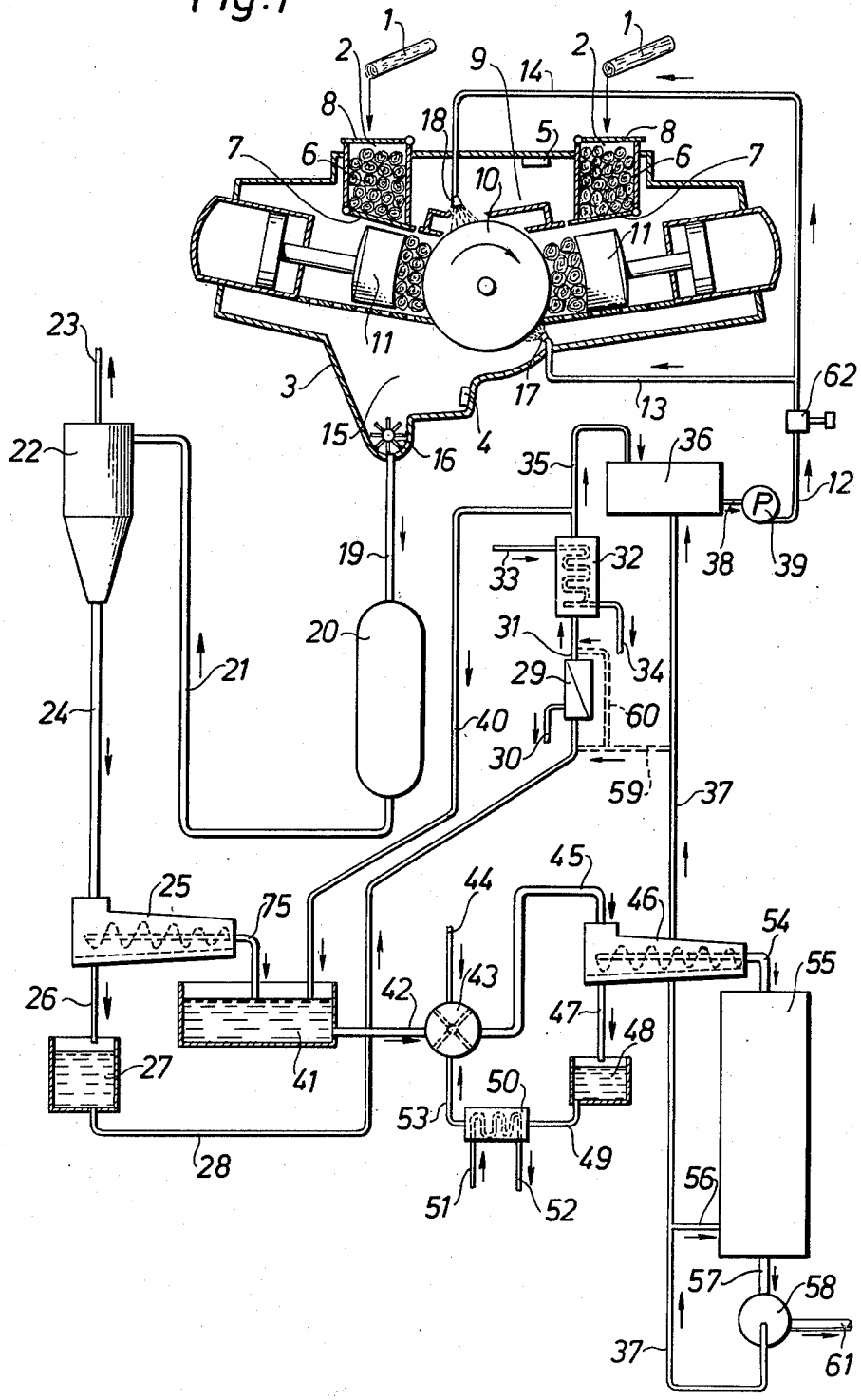
FIG. 1 shows a process of the invention applied in combination with subsequent bleaching of the groundwood pulp.

In the process represented in FIG. 1, debarked pulpwood logs 1 having a moisture content of from 30 to 65% are carried via two sluice gate feeders 2 to a grinder 3. The grinder is provided with transducers for measuring temperature 4 and pressure 5. The sluice gate feeders each have a chamber 6 having a pivotable bottom or floor 7 and a pivotable top cover 8. In the sluice gate feeder there is some preheating of the logs by means of steam generated in the grinder 3, but steam from any stage in the process where surplus steam is available may also be used. The preheated logs are fed into the grinding chamber 9 by rapidly pivoting the bottom 7 of the sluice feeder, so that the logs fall by gravity down against the rotating grindstone 10. In order to press the logs smartly against the grindstone surface, a hydraulic piston-type ram 11 is brought to bear, and press them against the grindstone. A suitable ram pressure is from 4 to 40 kiloponds/cm$^2$, preferably from 6 to 30 kiloponds/cm$^2$. A superatmospheric pressure of from 0.2 to 10.0 kiloponds/cm$^2$ is maintained within the grinder 3. During the grinding of the wood shower water is added through the pipe 12, and distributed by sprayheads 17, 18 at the ends of the pipes 13 and 14 onto the surface of the grindstone.

The volume of shower water thus applied can be varied between 100 liters and 580 liters per minute, at a production rate of 1 ton of pulp per hour. The temperature of the shower water that is added and the volume are regulated in such a way that the groundwood pulp suspension discharged at the outlet 15 of the grinder, which is equipped with a splinter crusher 16, has a temperature which is from about 1.5 to about 50, preferably from 2 to 8, times that of the shower water, and the outgoing pulp suspension has a pulp concentration of at least 3.0%. Furthermore, the shower water should be delivered at a pressure which is from about 8 to about 40, preferably from 10 to 30, kiloponds/cm$^2$ higher than the superatmospheric pressure in the grinder 3.

From the grinder outlet 15, defibrated pulp suspension is fed through the pipe 19 to a surge tank 20 under the same superatmospheric pressure. From the surge tank, the pulp suspension is carried through the pipe 21 to a hydrocyclone 22, in which steam at a temperature of between 100° and 170° C. is separated and discharged through the pipe 23, for recovery of its heat content. An example of such recovery is via a turbine for generation of electricity, or a heat exchanger for the heating of air for a hot air dryer, for instance a flash dryer or a drum dryer in a paper machine. The surplus steam can also be used for the drying of pulp in a counter current dryer of the type described in U.S. Pat. No. 3,492,199, patented Jan. 27, 1970. Heating of rooms and preheating of wood are other examples of suitable uses of the surplus steam.

From the hydrocyclone, the pulp is transported through the pipe 24 to a dewatering press 25, in which it is thickened from a concentration of from 3.0 to 20% to a concentration of from 8 to 50%. The process water leaving the press through the pipe 26 has a temperature of from 80° to 100° C., and is pumped via the receptacle 27 and the pipe 28 to a filter 29 for the separation of fiber residues, which leave through the pipe 30, and then passes through the pipe 31 to a heat exchanger 32, where it is cooled.

The cooling water is supplied through the pipe 33 and is removed through the pipe 34. It has a temperature of about 40° to 60° C., and its heat content can be used for heating or washing purposes.

The process water, cooled down to a temperature of from 2° to 63° C., preferably from 20° to 50° C., is carried through the pipe 35 from the heat exchanger to a reservoir 36, to which spent bleaching liquor, if desired, can be supplied through the pipe 37. From the reservoir 36, the process water is carried through the pipe 38 to the high pressure pump 39, and then pumped through the pipe 12.

A part of the cooled process water leaving the heat exchanger 32 can be transferred via the pipe 40 to the pulp suspension discharged from the press 25, for dilution in the vessel 41. By this arrangement, the temperature of the pressed pulp can be regulated.

In accordance with an especially advantageous embodiment of the invention, the thickened pulp is carried from the vessel 41 through the line 42 to a mixer 43, for the addition of bleaching chemicals via the pipe 44. Thereby, the pulp is diluted to a concentration of from 10 to 15%. Immediately after the addition of bleaching chemicals, the pulp is carried through the pipe 45 to a dewatering press 46, in which the pulp is rapidly dewatered. The pressed-out bleaching agent solution is carried through the pipe 47 to a vessel 48, from which it is introduced via the pipe 49 into a heat exchanger 50, where it is cooled with cooling water which is circulated through the pipes 51 and 52. The spent cooling water can be used for the same purposes as the cooling water in the heat exchanger 32. The cooled bleaching agent solution is recycled via the pipe 53 to the mixer 43.

This special fast dewatering process gives the advantage that a high brightness is obtained with a low consumption of chemicals.

The dewatered pulp mixed with bleaching chemicals is transferred via the pipe 54 to a bleaching tower 55, in which it is subjected to bleaching, preferably at a temperature of from 40° to 75° C., and a pulp concentration of from 10 to 50%, over a retention time of from 15 to 180 minutes. Before leaving the tower, the pulp is diluted to a pulp concentration of from 1 to 6% with spent bleaching liquor supplied through the pipe 56.

The bleached pulp is removed through the pipe 57, and then thickened on a filter or in a press 58 to a pulp concentration of from 10 to 50%, after which it is dried or carried directly to an integrated paper mill. Spent bleaching liquor leaving the thickening apparatus 58 is recycled partly as dilution liquid in the bleaching tower 55 through the pipe 56, partly to the shower water reservoir 36 through the pipe 37, for mixing with the cooled and purified process water from the heat exchanger 32. If desired, the spent bleaching liquor leaving the thickening apparatus 58 wholly or partly via the optional pipes 59 and 60 may be added to the pipes 28 and/or 31, if a further filtration and/or cooling is needed.

After the bleaching, it is suitable to screen the pulp before drying, or before the preparation of paper in an integrated paper mill. It is also possible to screen the pulp before bleaching and after thickening bleach the pulp.

Figure 2:
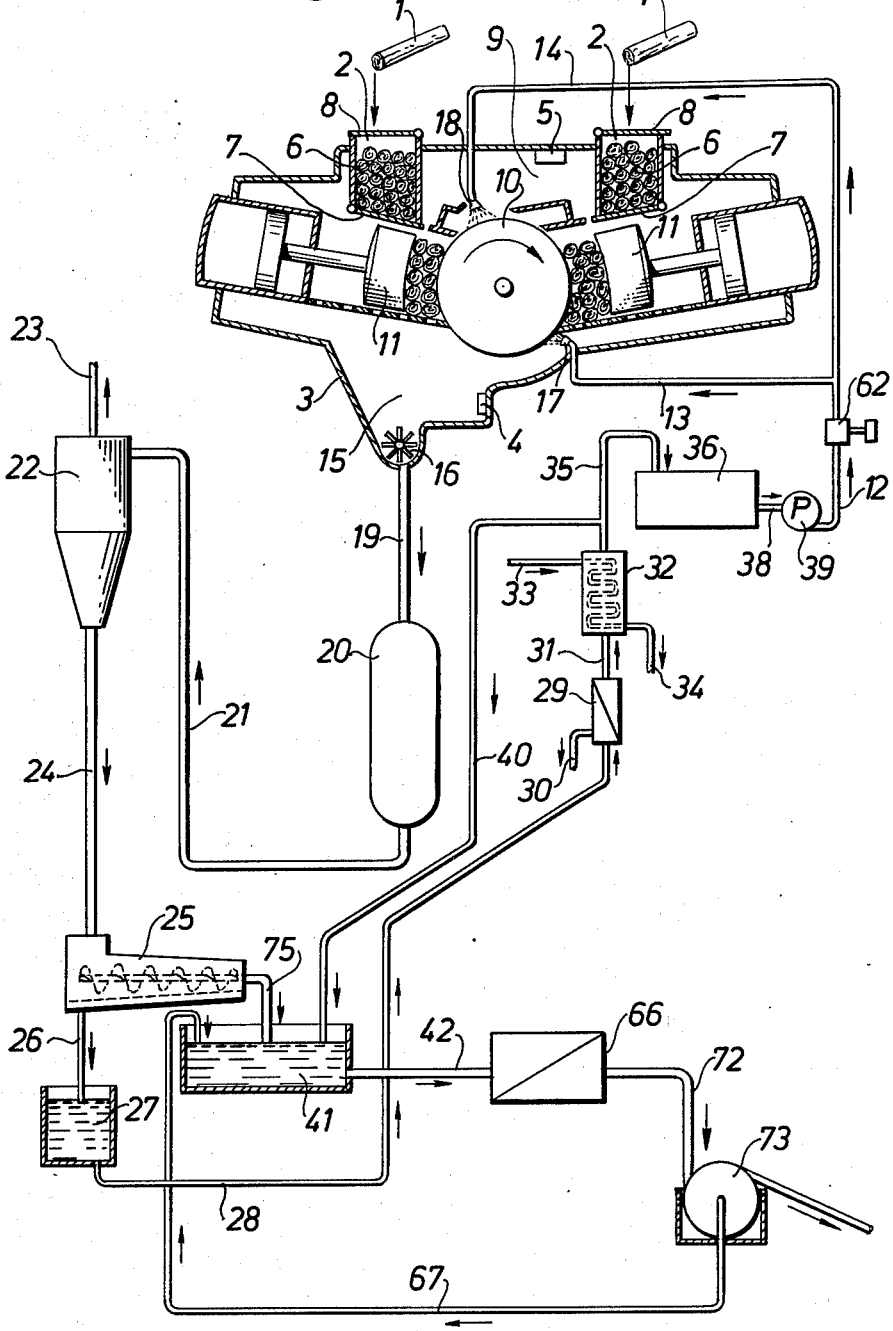
FIG. 2 shows a process applied without a subsequent bleaching stage.

In the system shown in FIG. 2, the processing is the same as that in FIG. 1, with like parts being given like reference numerals, except that the pulp is not bleached but instead carried from the press 25 via pipe 75 for dilution in the collecting tank 41, whence it passes through the pipe 42 directly to the screening stage 66, after which it is carried through the pipe 72 to the drum filter 73 for dewatering. The process water leaving the filter 73 is recirculated through the pipe 67 to the collecting tank 41. The pulp from the filter 73 is transferred to a wet lap-forming machine and a drying plant, not shown in the Figure. In the same way as shown in FIG. 1, process water from the dewatering press 25, after filtering and cooling, is used as shower water, which is added in small amounts. At the same time, large amounts of heat are recovered, in spite of a high temperature in the grinder.

The process of the invention can be applied at a superatmospheric pressure in the grinder of within the range from about 0.2 to about 10 kiloponds/cm$^2$.

The temperature of the shower water that is added to the grinder can as a rule be kept within the range from about 2° to about 63° C., the temperature range from 20° to 50° C. being especially suitable.

The amount of shower water is less than 35 parts by volume per part of bone dry pulp, and preferably is from about 3 to about 30 parts by volume per part of bone dry pulp.

According to the invention it is especially suitable to separate steam centrifugally from the groundwood pulp suspension from the grinder in a hydrocyclone. The heat content of the steam is utilized in the process, or outside the process.

The process of the invention has special advantages when the groundwood pulp suspension coming from the hydrocyclone is thickened to a solids content of from 20 to 50%, and then bleached. It is then very advantageous to cool the liquor withdrawn in the thickening process, and recirculate it as shower water. Spent bleaching liquor and/or fresh bleaching agent solution can advantageously be added to this cooled liquor and the liquors can be mixed.

In application of the invention in combination with a bleaching stage, it is especially suitable to mix spent bleaching liquor from a separate peroxide bleaching stage with the shower water, in accordance with the process described in U.S. Pat. No. 4,029,543. Such spent bleaching liquor contains organic chemicals such as organic acids originating from decomposition and dissolution of the lignocellulosic material, such as formic acid, acetic acid, oxalic acid, different fatty and resin acids, and organic complex-forming compounds and inorganic chemicals, such as hydrogen peroxide, dithionites, sodium hydroxide, sodium silicate, sodium phosphate and magnesium sulphate. It can, if desired, in addition be admixed with stabilizing agents for the bleaching chemicals, such as magnesium sulphate, with complex forming agents for binding the heavy metals, such as ethylene diamine tetraacetic acid (EDTA), and with further fresh bleaching chemicals and with pH-regulating substances such as alkali hydroxides and alkali silicates.

The supply of water to the grinding can be by any conventional means. A high pressure pump is suitable, supplied with recirculated water, such as process water from the dewatering stage, and optionally spent bleaching liquor, to the suction side of the pump. The mixing of the water and any spent bleaching liquor can take place before or after delivery to the pump. The proportion of such spent bleaching liquor and process water depends on the process heat balance, especially the temperature used in the bleaching, and can be within the range from about 1:30 to about 5:1.

The pulp suspension coming from the grinder after the disintegration of coarse wood particles in a splinter crusher is advantageously transferred via an intermediate pressure-seal tank to a hydrocyclone for the separation of steam. It is of course also possible to recover heat generated in the grinding by mixing the hot groundwood pulp obtained with cool groundwood pulp. The surplus steam is utilized for heating purposes in connection with the process, or for other heating requirements. In the same way surplus steam which is discharged from the grinder can be utilized, for instance, for heating of the wood in the sluice gate feeder.

According to an especially advantageous embodiment of the invention in combination with a bleaching stage, the groundwood pulp coming from the hydrocyclone is thickened in a suitable apparatus, for instance a band filter or a press, so that the pulp has a solids content of from 20 to 50%.

Any known method for bleaching the groundwood pulp can be used, using, for example, chlorinating bleaching agents such as chlorine, hypochlorite and chlorine dioxide, and mixtures thereof; sodium peroxide, hydrogen peroxide and other peroxide bleaching chemicals; and sodium dithionite or sodium hydrosulphite.

The bleaching can be carried out in a bleaching tower and before bleaching it is advantageous to thicken the pulp suspension immediately after mixing with the bleaching chemicals and before introduction into the tower and to recycle the excess bleaching agent solution to the mixing apparatus after cooling.

During the grinding step, the superatmospheric pressure should be within the range from about 0.2 to about 10 kp/cm$^2$ above atmospheric pressure, and the temperature of the water or aqueous solution supplied to the grinding should be within the range from 2° to 63° C. Using debarked logs as the raw lignocellulosic material, the pressure of the logs against the grindstone surface should be within the range from about 4 to about 40 kp/cm$^2$ and preferably from about 6 to about 30 kp/cm$^2$.

The following Examples in the opinion of the inventor represent preferred embodiments of the invention:

EXAMPLE 1

This Example illustrates the production of bleached groundwood pulp from debarked spruce logs. The process of the invention (Method A) is compared with the prior art process using grinding in closed chamber at elevated pressure and with a large volume of spray water at elevated temperature and with the addition of bleaching chemicals (Method B). In accordance with the invention, a considerably smaller volume of shower water derived from cooled-down process water containing spent bleaching liquor was used.

One of eight grinders in a groundwood pulp mill and adapted to operate at atmospheric pressure was rebuilt for use under superatmospheric pressure in accordance with FIG. 1. In all test runs, debarked spruce logs having an average moisture content of 52% were fed to the grinder in an amount of 300 kgs of dried wood. The ram pressure urging the logs against the surface of the grindstone was 7 kiloponds/cm$^2$. At this ram pressure, the average power by the drive motor in operating the grindstone was measured at 1400 kW. The superatmospheric pressure within the grinder was 1.0 kilopond/cm$^2$. Other conditions in the test runs were varied, as described below.

Method A (the invention)

In this test run, cooled-down shower water which had been mixed with spent bleaching liquor obtained from the pipe 37 was used. No fresh bleaching chemicals were added. The shower water in the container 36 had the following composition:

| | g/l |
|---|---|
| Hydrogen peroxide | 0.48 |
| $Na_2SiO_3$ (water-glass) | 2.57 |

-continued

| | g/l |
|---|---|
| Diethylene triamine pentaacetic acid (DTPA) | 0.07 |
| Acetic acid | 2.95 |
| Resin and fatty acids | 0.22 |
| pH observed | 8.1 |

The temperature of the shower water at the sprayheads 17 and 18 was 38° C. The shower water was applied at a rate of 380 liters/minute, and the shower water was injected at a superatmospheric pressure of 14 kiloponds/cm$^2$, as compared to the pressure within the grinder. At the discharge outlet 15 of the grinder, the temperature of the groundwood pulp suspension was 115° C., which is 3.02 times higher than the temperature of the added shower water. The pulp concentration at the discharge from the hydrocyclone 22 was 6.25%, which is 3.2 times higher than in Method B below.

The pulp was dewatered in the press 25 and mixed with bleaching chemicals in the mixer 43. The liquor leaving the press 25 was collected in the vessel 27, and transferred by the pipe 28 to the filter 29 for separation of residual fibers. Separated fiber residues were removed through the pipe 30. The purified liquor was transferred to a heat exchanger 32. Cooled water (6° C.) was supplied to the heat exchanger through the pipe 33, and was removed through the pipe 34 at a temperature of 57° C. The heated water was used for heating purposes. From the heat exchanger 32 the liquor which had been cooled down to 22° C. was carried to the reservoir 36, in which it was mixed with spent bleaching liquor supplied through the pipe 37.

Immediately after the addition of bleaching chemicals the pulp was carried through the pipe 45 to the dewatering press 46, and then to the bleaching tower 55, where bleaching was continued for two hours at a temperature of 59° C. In the lower part of the tower the bleached pulp was diluted from a 20% pulp concentration to a 3.5% pulp concentration with spent bleaching liquor, added through the pipe 56. The diluted pulp suspension was carried through the pipe 57 to a dewatering apparatus 58, in which the pulp suspension was thickened to a solids content of 42%, after which it was removed via the pipe 61. The greater amount of the pressed-out spent bleaching liquor was carried through the pipe 56 to the bottom of the bleaching tower. The excess spent bleaching liquor (about 2.5 m$^3$ per ton of dry pulp) was recycled via the pipe 37 to the reservoir 36, in which the spent bleaching liquor was mixed with cooled-down liquid supplied through the pipe 35.

The discharged thickened pulp was diluted, screened and thickened on a wet lap-forming machine and dried in a flash dryer (not shown in the Figure). From the screening stage pulp samples were taken, which were dewatered, dried and analyzed in a laboratory.

The results are given in Table I as average values from three test runs. In addition to pulp and paper properties, the Table also shows energy consumption data.

Method B (Prior art)

Figure 3:
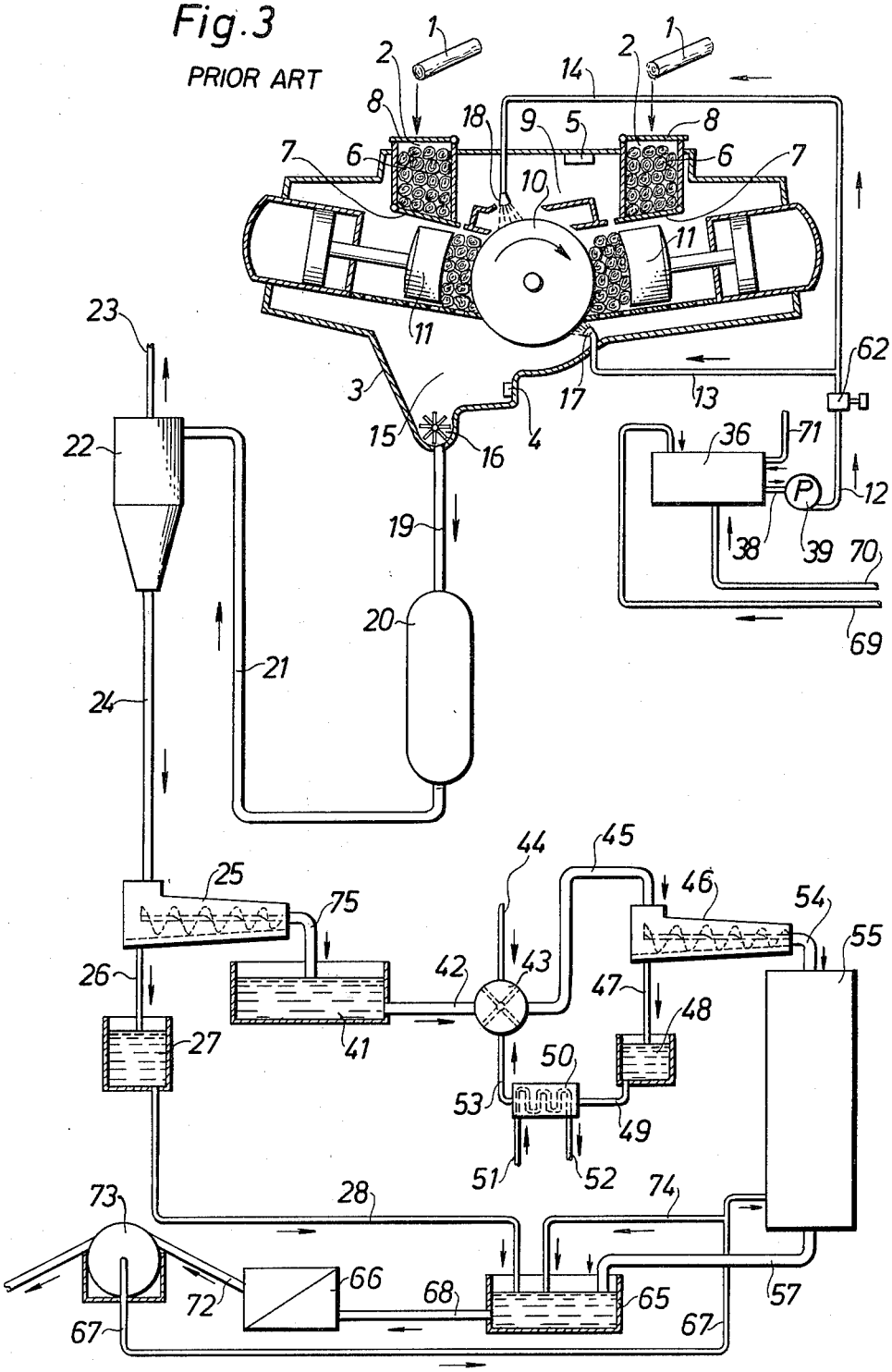
Fig.3 PRIOR ART
FIGS. 3 and 4 show processes of the prior art and represent controls in the comparative tests described in Examples 1 and 2.

In this test run, the apparatus shown in FIG. 3 was used. This is substantially the same apparatus that is shown in FIG. 1, with the difference that the heat exchanger 32 and the filter 29 was disconnected, so that the process water used as shower water was neither filtered nor cooled. Furthermore, the pipe 37 for recycling pressed-out spent bleaching liquor for mixing into the shower water was closed. The shower water in the pipe 12 was obtained from the reservoir 36, to which were added fresh water having a temperature of 18° C. via the pipe 69; external steam for the heating of the shower water to a temperature of 92° C. via the pipe 70; and, via the pipe 71, fresh bleaching agent solution containing stabilizing and buffering agents and complex forming agents, which bleaching agent solution had the following composition:

| | g/l |
|---|---|
| Hydrogen peroxide | 0.5 |
| $Na_2SiO_3$ (water glass) | 2.0 |
| Diethylene triamine pentaacetic acid (DTPA) | 0.08 |
| NaOH to pH | 8.3 |

The shower water applied to the surface of the grindstone was measured in the flow meter 62 at a rate of 1200 liters per minute. The injection pressure was 6 kiloponds/cm$^2$ higher than the pressure within the grinder. The temperature of the groundwood pulp suspension at the discharge oulet 15 of the grinder was found to be 108° C., which was 1.17 times higher than the temperature of the added shower water. After the pulp had passed the splinter crusher 16, it was transferred via the pipe 19 to the tank 20, and from there via the pipe 21 to the hydrocyclone 22 for the separation of steam, which was removed through the pipe 23 and supplied to a heat exchanger (not shown in the Figure) for the recovery of the heat content of the steam. The pulp concentration at the discharge from the hydrocyclone was 1.96%.

The pulp suspension was led through the pipe 24 to a dewatering press 25 where it was brought to a pulp concentration of 21%. The pressed-out liquor was transferred via the vessel 27 through the pipe 28 to a vessel 65 for dilution of the bleached pulp, which was supplied through the pipe 57. The pulp from the press 25 was transferred via the vessel 41 and the pipe 42 to a mixer 43 for admixture of bleaching chemicals, which were added through the pipes 44 and 53.

The pulp suspension after mixing with bleaching chemicals had a pulp concentration of 10%, and was immediately transferred to the press 46 via the pipe 45 for dewatering to a pulp concentration of 20%. The pressed-out bleaching agent solution was collected in the container 48 via the pipe 47 and carried through the pipe 49 and the heat exchanger 50 through the pipe 53 back to the mixer 43, for mixing with a new portion of pulp.

The pulp from the press 46 was carried through the pipe 54 to the bleaching tower 55. In the bleaching tower the temperature was 59° C. and the pulp concentration 20%. After bleaching for two hours, the pulp was diluted to a pulp concentration of 3.5% with process water added through the pipe 67 and coming from the drum filter 73. After dilution in the lower part of the tower the pulp was carried through the pipe 57 to the vessel 65. From this vessel the pulp suspension was transferred through the pipe 68 to the screening stage 66, after which the pulp was carried through the pipe 72 to the drum filter 73 for dewatering. Spent bleaching liquor leaving the filter 73 was transferred partly through the pipe 67 to the bleaching tower 55 and partly through the pipe 74 to the collection tank 65.

From the screening stage pulp samples were taken, which were dewatered, dried and analyzed in a laboratory. The results are shown in table I as the average values of three test runs. In addition to pulp and paper properties, the Table gives data on the energy consumption.

TABLE I

| Method | Method B | Method A |
|---|---|---|
| Energy consumption in defibration, kWh/ton | 1080 | 1010 |
| Energy consumption for heating of the shower water, kWh/ton | 4750 | 0[1] |
| Freeness, ml | 165 | 162 |
| Long fiber content according to Bauer McNett (+30 mesh) | 28 | 29 |
| Breaking length index,Newtonmeters/kg | 34 | 37 |
| Tear index, Newtonsquaremeters/kg | 5.3 | 5.3 |
| Density, kg/m$^3$ | 382 | 383 |
| Brightness, according to SCAN, % | 67 | 70 |
| Opacity, % | 91.7 | 92.1 |

[1]The heating of the cooling water in the heat exchanger 32 corresponded to a recovery of 600 kWh/ton of pulp.

As is apparent from the Table, the groundwood pulp prepared according to the invention (Method A) had substantially the same properties as pulp prepared according to the prior art (Method B). The pulp prepared according to the invention, however, surprisingly enough had a higher brightness than the prior art pulp. This may result from the fact that less decomposition of peroxide is obtained in the process of the invention, since the shower water is colder.

An important advantage of the present invention is the substantially lower total energy consumption. Very large amounts of energy are saved because the shower water does not need to be heated. Furthermore the consumption of energy in defibration was less in the process according to the invention. In addition to this energy savings corresponding to 600 kWh/ton were obtained by recovering the heat content of the process water obtained in the thickening of the pulp suspension after the hydrocyclone.

EXAMPLE 2

This Example shows the preparation of unbleached groundwood pulp from debarked spruce wood logs, and compares the process of the invention (Method C), using substantially less shower water, which has been cooled down, with the prior art method with grinding in a closed chamber at elevated pressure and with a large volume of hot shower water (Method D). In all the test runs, substantially the same modified grinder and the same run conditions as described in Example 1 were used, with the differences stated below.

Method C (the invention)

In this test run, the apparatus shown in FIG. 2 was used. This apparatus corresponds broadly to the apparatus of FIG. 1, but with the bleaching tower disconnected.

Debarked spruce logs 1 with an average moisture content of 52% were fed to the grinder 3 shown in the Figure in an amount of 300 kgs of dry wood in each test run. The average power during the grinding was 1400 kW. The superatmospheric pressure in the grinder was 1.0 kilopond/cm$^2$. The temperature of the shower water at the sprayheads 17 and 18 was 36° C. The shower water was applied to the grindstone as measured with the flow meter 62, at a rate of 392 liters/minute, and the injection pressure of the spray water was 16 kiloponds/cm$^2$ higher than the pressure in the grinder, which was kept at a superatmospheric pressure of 1.0 kilopond/cm$^2$. The volume of the shower water thus was 15.7 parts per part of dry pulp, and the temperature of the pulp suspension at the discharge outlet 15 from the grinder was 114° C., which corresponded to 3.2 times the temperature of the shower water added.

When the groundwood pulp obtained had passed the splinter crusher 16, it was carried further through the pipe 19 to the equalizing tank 20, and from there through the pipe 21 to the hydrocyclone 22, in which steam was separated, and removed through the pipe 23. This steam was utilized for the heating of a flash dryer (not shown in the Figure). The pulp suspension leaving the hydrocyclone had a concentration of 7.15%, which was 2.93 times higher than the concentration in grinding according to the prior art.

The pulp suspension was carried through the pipe 24 to the press 25, in which it was dewatered to a concentration of 15%. From the press the pulp was transferred via the pipe 75 to the collection tank 41, and from there via the pipe 42 to the screening stage 66. The pulp suspension was then carried through the pipe 72 to the drum filter 73. The process water leaving the drum filter was recycled through the pipe 67 to the collection tank 41, for dilution of the pulp before screening.

Process water leaving the press 25 through the pipe 26 and having a temperature of 94° C. was transferred to the vessel 27 and from there via the pipe 28 to the filter 29, and through the pipe 31 to the heat exchanger 32, where it was cooled from about 90° C. to 36° C. Cooling water at a temperature of 8° C. was supplied to the heat exchanger through the pipe 33, and removed through the pipe 34 at a temperature of 51° C. The cooled process water was transferred via the pipe 35 to the reservoir 36, from which it was pumped through the pipes 12, 13 and 14 to the grinder, where it was applied as shower water. Test samples were taken from the screened pulp for analysis of pulp and paper technical properties. The results of the analysis and the energy consumption are shown in Table II.

Method D (Prior Art)

Figure 4:
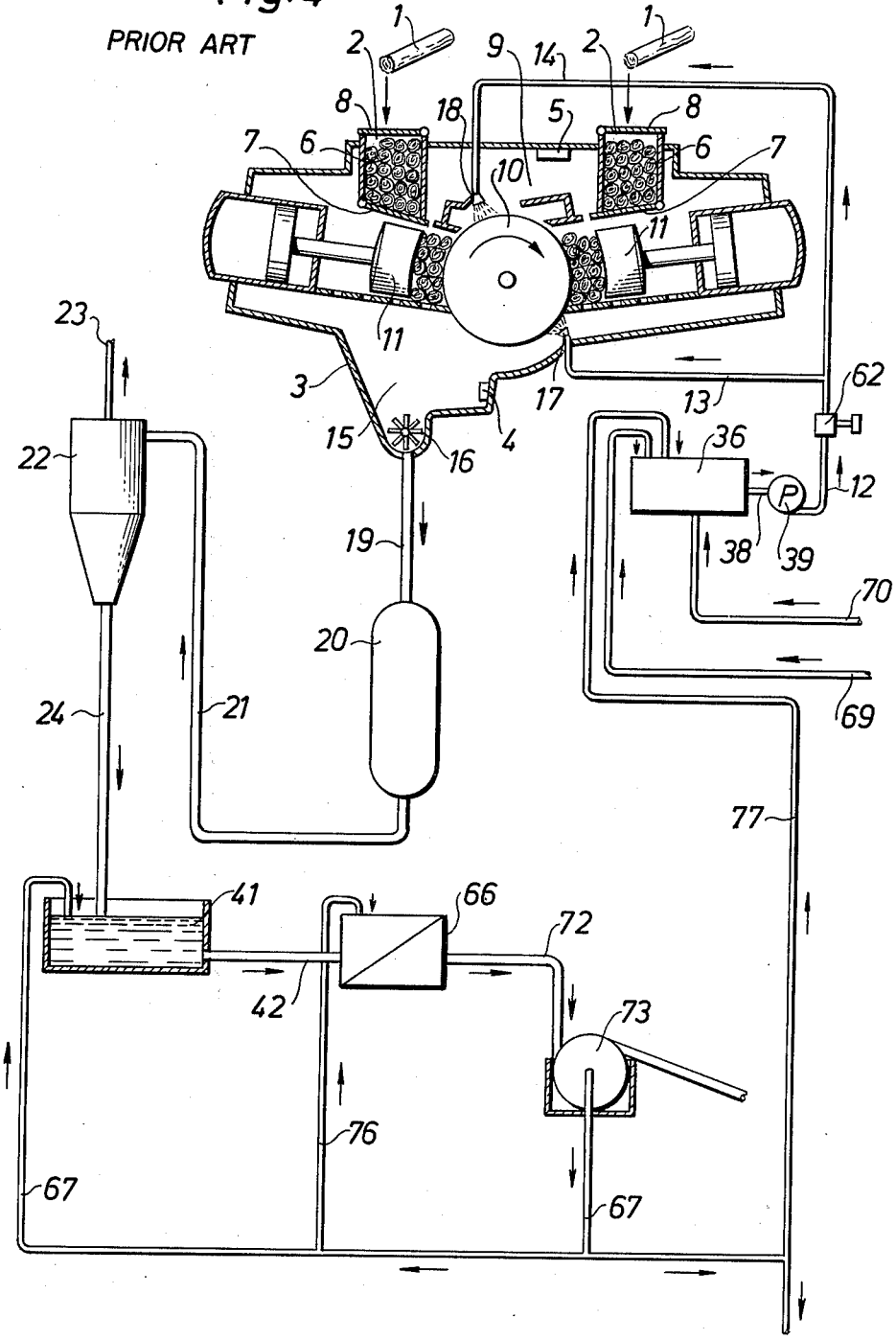
Fig. 4 PRIOR ART

In this test run, the apparatus shown in FIG. 4 was used, which up to the hydrocyclone 22 corresponds to the apparatus shown in FIG. 2. From the hydrocyclone the pulp suspension was carried via the pipe 24 to the collection tank 41, where it was diluted with process water from the drum filter 73, which was added through the pipe 67. The diluted pulp suspension was transferred via the pipe 42 to the screening stage 66, and from there via the pipe 72 to the drum filter 73, where it was dewatered.

The process water leaving the drum filter was in part recycled back to the collection tank 41, and in part recycled through the pipe 76 to the screening stage 66. A further part of the process water leaving the drum filter 73 was transferred via the pipe 77 to the reservoir 36, to which cooled fresh water was added through the pipe 69 and external steam for heating purposes was added through the pipe 70.

A superatmospheric pressure of 1.0 kilopond/cm$^2$ was maintained in the grinder. The temperature of the shower water supplied through the pipes 13 and 14 was 98° C., and it was added at a rate of 1000 liters/minute, that is 41.5 parts per part of dry pulp. At the discharge outlet 15 of the grinder the temperature of the pulp suspension was 110° C., which is 1.1 times higher than the temperature of the added shower water.

The pulp concentration as the discharge outlet 15 from the grinder was 2.41%, and at the discharge from the hydrocyclone 2.44%. The pulp concentration in the vessel 41 was 1.0% after the dilution. Process water left the drum filter at a rate of 2800 liters/minute, of which 2000 liters/minute were distributed between the vessel 41 (1400 liters/minute) and the screening stage 66 (600 liters/minute). Of the remaining 800 liters/minute, 500 liters/minute were recycled via the pipe 77 to the reservoir 36, whereas the remaining 300 liters/minute was discharged to waste.

The temperature of the process water in the pipe 77 was 68° C. Through the pipe 69 fresh water at a temperature of 18° C. was added at a rate of 500 liters/minute. Test samples were taken from the screened pulp for analysis of pulp and paper technical properties. The results of the analysis and the energy consumption are shown in Table II.

TABLE II

| | Method D | Method C |
|---|---|---|
| Energy consumption in defibration, kWh/ton | 970 | 935 |
| Energy consumption for heating the shower water, kWh/ton | 2650 | 0 |
| Freeness, ml | 208 | 197 |
| Breaking length index, Newtonmeters/kg | 29 | 31 |
| Tear index, Newtonsquaremeters/kg | 5.4 | 5.5 |
| Density, kgs/m$^3$ | 340 | 335 |
| Brightness according to SCAN, % | 60 | 61 |
| Opacity % | 90.2 | 90.2 |

As is evident from the Table, the energy consumption was considerably lower in the grinding process according to the invention (Method C) than in the grinding according to the prior art (Method D). Surprisingly enough, it is not possible to find any differences in the pulp and paper properties.

An important advantage in the application of the present invention is that the pulp has a high pulp concentration at the discharge outlet from the hydrocyclone. If the pulp is to be bleached, it is possible to directly dewater the pulp suspension further to a higher concentration by means of relatively simple apparatus. In order to avoid large fiber contents in the back water when grinding by the prior art method, the pulp suspension must first be thickened on a filter because of its low pulp concentration, which is wasteful of space and expensive.

With regard to the process and apparatus disclosed in Swedish Pat. No. 318,178 and U.S. Pat. No. 3,808,090 it is to be noted that the grinder used is described in an article in *Pulp & Paper Magazine of Canada,* August, 1965, pages T 399–T 406. At page T 400 it is disclosed that the logs were $3\frac{1}{8}''\times3\frac{1}{8}''$, which means that the edges were 79.4 mm. Maximal grinding velocity was 1.05 mm/sec. Within one second the volume of wood that had been ground corresponded to $1.05\times79.4\times79.4$ mm$^3$=6.62 cm$^3$. At the same time, Swedish Pat. No. 318,178 and U.S. Pat. No. 3,808,090 reveal that the density of the wood was 0.423 g/cm$^3$, showing that $0.423\times6.62=2.80$ grams of pulp were ground during 1 second. The reference furthermore discloses that the wood contained 28.4% of moisture, so that the weight of pulp prepared per second was $0.716\times2.80=2.00$ g.

This corresponds to a production of $2.00 \times 60 = 120$ g of dry pulp per minute. In Table I in Swedish Pat. No. 318,178 and U.S. Pat. No. 3,808,090 it is disclosed that the shower water flow rate was about 9.5 liters/minute. This means that 79.0 parts of water per part of pulp were added.

It should also be observed that these figures are obtained at the maximum grinding velocity, according to Swedish Pat. No. 318,178 and U.S. Pat. No. 3,808,090.

This calculation shows clearly that the cited Example cannot be compared to the process of the invention.

In slow grinding, that is, conventional grinding according to these patents, the dilution with water will be 2 to 3 times greater than in the above Examples. As compared with this invention there are thus very large differences in the volume of shower water.

In these patents there are Examples using shower water temperatures of 150° C. If shower water having such high temperatures were used in the process of the invention, the temperature would be at least 225° C. within the grinder, which corresponds to a superatmospheric steam pressure of 25 kiloponds/cm$^2$. These patents state however that the maximum superatmospheric pressure should be 10.5 kiloponds/cm$^2$. At a pressure of 25 kiloponds/cm$^2$, a normal pressure grinder would explode. To withstand such pressures, the grinder would weigh about 1000 tons, which is completely impractical.

Having regard to the foregoing disclosure the following is claimed as the inventive and patentable embodiments thereof:

1. A process for preparing groundwood pulp from debarked pulpwood logs, which comprises grinding the logs in the presence of water under a superatmospheric pressure of a gas selected from the group consisting of steam, air, and steam and air, and forming and discharging a pulp suspension in the resulting aqueous liquor, while continuously supplying said water to the grinding in a volume of less than 35 parts per part of bone dry pulp at a rate of addition such that the temperature of the discharged pulp suspension is below 200° C. and within the range from about 1.5 to about 50 times the temperature in °C. of the added water, at a pressure within the range from about 8 to about 40 kiloponds/cm$^2$ higher than the superatmospheric pressure of said gas and at a temperature within the range from about 2° to about 63° C.

2. A process according to claim 1, in which the temperature of the discharged pulp suspension is below 180° C., and within the range from 2 to 8 times the temperature of the added water.

3. A process according to claim 2 in which the pressure of the added water is from 10 to 30 kiloponds/cm$^2$.

4. A process according to any of claims 1, 2 or 3 in which the added water is at a temperature of from 20° to 50° C.

5. A process according to any of claims 1, 2 or 3 in which the volume of added water is within the range from 3 to 30 parts per part of bone dry pulp.

6. A process according to any of claims 1, 2 or 3 in which the superatmospheric pressure during the grinding is maintained at from 0.2 to 10 kiloponds/cm$^2$.

7. A process according to any of claims 1, 2 or 3 which includes centrifugally separating steam from the pulp suspension and using the separated hot steam for heating purposes.

8. A process according to any of claims 1, 2 or 3 which includes thickening the pulp suspension to a solids content within the range from about 5 to about 50%.

9. The process of claim 8, in which the liquor obtained in the thickening is cooled and recirculated to the grinding as added water.

10. The process of claim 9, in which the cooled liquor obtained from the thickening operation is mixed with at least one of spent bleaching liquor and fresh bleaching liquor before being recirculated to the grinding.

11. A process according to any of claims 1, 2 or 3 which includes adding bleaching chemicals to the pulp and bleaching the pulp.

* * * * *